US007137172B2

(12) United States Patent
Elmer

(10) Patent No.: US 7,137,172 B2
(45) Date of Patent: Nov. 21, 2006

(54) SUSPENSION ARRANGEMENT

(75) Inventor: Hubert Elmer, Innsbruck (AT)

(73) Assignee: Dorma GmbH + Co. KG, Ennepetal (DE)

( * ) Notice: Subject to any disclaimer, the term of this patent is extended or adjusted under 35 U.S.C. 154(b) by 86 days.

(21) Appl. No.: 10/498,630

(22) PCT Filed: Apr. 25, 2003

(86) PCT No.: PCT/EP03/04299

§ 371 (c)(1),
(2), (4) Date: Jun. 12, 2004

(87) PCT Pub. No.: WO03/091522

PCT Pub. Date: Nov. 6, 2003

(65) Prior Publication Data

US 2005/0072890 A1 Apr. 7, 2005

(30) Foreign Application Priority Data

Apr. 26, 2002 (DE) ..... 102 18 873

(51) Int. Cl.
*A47H 15/00* (2006.01)
*E05D 13/00* (2006.01)

(52) U.S. Cl. ..... 16/105; 16/89; 248/307; 104/108; 49/409

(58) Field of Classification Search ..... 248/307, 248/304, 305, 306, 317, 340; 16/105, 94 R, 16/102, 66, 89; 104/94, 108; 160/87; 49/379, 49/409

See application file for complete search history.

(56) References Cited

U.S. PATENT DOCUMENTS

| | | | | |
|---|---|---|---|---|
| 365,240 | A * | 6/1887 | Coburn | 104/108 |
| 1,116,331 | A | 11/1914 | Schlosser | |
| 1,606,450 | A | 11/1926 | Royer | |
| 1,994,782 | A * | 3/1935 | Olson | 104/94 |
| 2,482,855 | A * | 9/1949 | Lloyd | 16/89 |
| 2,654,114 | A * | 10/1953 | Graber et al. | 16/93 D |
| 2,680,875 | A * | 6/1954 | Coffey | 16/105 |
| 2,726,420 | A * | 12/1955 | Kemp | 16/87 R |
| 2,843,872 | A | 7/1958 | Hannon | |
| 2,999,267 | A * | 9/1961 | Sterling et al. | 16/105 |
| 3,011,209 | A * | 12/1961 | Majeske | 16/105 |
| 3,055,420 | A * | 9/1962 | Del Faro et al. | 160/347 |
| 3,076,222 | A * | 2/1963 | Sloan | 16/98 |
| 3,182,350 | A * | 5/1965 | Witten | 16/105 |
| 3,203,027 | A * | 8/1965 | Ohman | 16/105 |
| 3,261,052 | A * | 7/1966 | Galland | 16/87.6 R |
| 3,555,612 | A * | 1/1971 | Procton | 16/105 |
| 3,747,158 | A * | 7/1973 | Craig et al. | 16/105 |

FOREIGN PATENT DOCUMENTS

| | | |
|---|---|---|
| DE | 564572 | 11/1932 |
| EP | 1 045 100 | 10/2000 |
| GB | 2 045 847 | 11/1980 |
| JP | 09-021268 | * 9/1997 |

* cited by examiner

*Primary Examiner*—Anita M. King
(74) *Attorney, Agent, or Firm*—Cohen, Pontani, Lieberman & Pavane

(57) ABSTRACT

The invention pertains to a hanger for guiding an element suspended from a rail so that the element can be moved back and forth. To create a hanger which forms a compact and visually attractive unit and which occupies the least possible amount of space without sacrificing the ability to serve various applications and to perform different functions, the hanger has an essentially flat, elongated shape with a middle section between two opposite end area, where the end areas are rounded.

11 Claims, 6 Drawing Sheets

SUSPENSION ARRANGEMENT

PRIORITY CLAIM

This is a U.S. national stage of application No. PCT/EP03/04299, filed on 25 Apr. 2003. Priority under 35 U.S.C. §119(a) and 35 U.S.C. §365(b) is claimed from German Application No. 102 18 873.4, filed 26 Apr. 2002.

BACKGROUND OF THE INVENTION

1. Field of the Invention

The invention pertains to a hanger for guiding an element suspended from a rail.

2. Description of the Related Art

Hangers of this kind can be used to suspend elements from a rail arrangement and to guide them so that they can be moved back and forth. In most cases, a support roller guides the hanger along the top of a rail, which is attached to a substructure.

A hanger of this type is known from U.S. Pat. No. 1,116,331. An adjustable keeper device is provided between the roller guided on the rail and the point where the movable element is attached to the hanger. The outward-extending, multi-part design of the hanger requires a complicated production procedure and is not optimal with respect to the economical use of material.

SUMMARY OF THE INVENTION

It is therefore the task of the present invention to create a hanger which forms a compact and visually attractive unit within the smallest possible space without sacrificing any of the previous ability of a hanger of this type to serve various applications and to fulfill different functions.

This task is accomplished by a hanger having a flat elongated shape with rounded and areas, a middle section, and a convex front surface.

With the hanger according to the invention, it has become possible, through an advantageous combination of the amount of material used and the external shape of the hanger, to create a unit which is both functional and visually attractive at the same time. A convex surface and rounded ends make it possible to construct a thin hanger of limited length, so that a compact unit is created. A hanger designed in this way makes it possible to utilize the construction space available in optimal fashion and also to optimize the production process and the amount of material used.

Although the amount of material required for the hanger according to the invention is extremely small, the stability and functional properties of the hanger are nevertheless ensured. The resulting outer contours have flowing transitions and therefore present an attractive appearance. All corners and edges are provided with radii. All thicknesses are reduced to a minimum. The flowing outlines of the outer contours, especially of the front and edge surfaces, considerably reduce the amount of material required and also reduce the problems associated with casting. Metal materials, plastics, and even so-called hybrid materials can be used. There are almost no restrictions on color. The properties mentioned also contribute greatly to the reduction of production costs.

Because the fastening shoulders/areas for the rollers and the connections to the suspended element or other attached components are covered, an advantageous visual concept is created, which harmonizes especially well with the clear, transparent appearance of dematerialized glass-metal construction. The fastening areas on the front and/or rear are protected by covers, so that no dirt which could interfere with operation can intrude. The hanger has no projecting or sharp-edged parts, which facilitates cleaning and eliminates any source of injury associated with the hanger.

The hanger has basically a flat, elongated shape with a middle section extending between two opposite ends. The two end areas are semicircular. The middle section is of uniform width, which continues into the two end areas and is equal to the diameter of the semicircles at the end.

The surface of the hanger facing the observer is not interrupted by any functional elements. The surface is slightly convex both in the longitudinal area between the ends and also between the lateral edges, from which the surface rises to form a slight elevation above the surrounding sides. Overall, a smooth, visually uniform surface is created. In the middle section, a cover, which conceals the area where a keeper is attached to the rear, fits flush with the surface.

On the rear surface facing away from the observer, a roller is attached to a bearing body at the upper end of the hanger. The roller guides the hanger on the rail so that the hanger can move back and forth. The bearing body is concealed from the observer by the rounded end area. At the bottom end, there are two point holders on the rear for the attachment of the element which is to be guided movably on the rail. These point holders are attached to shoulders connected to the hanger and are also concealed from the observer.

The keeper located on the rear surface of the middle section prevents the hanger from jumping off the rail unintentionally. After the hanger has been set on the rail, the keeper device is mounted and attached from the front side. In addition, a stopper can be mounted on the side of the hanger to ensure that the element comes to rest gently and without noise against an appropriate limiter. Fastening means/openings are required on the rear surface for both of these functions. So that a visually uniform surface can be achieved here as well, this area is concealed by a cover. At the same time, dirt is prevented from intruding into this area, where it could interfere with the operation of the unit.

DETAILED DESCRIPTION OF THE PRESENTLY PREFERRED EMBODIMENTS

Figure 1:
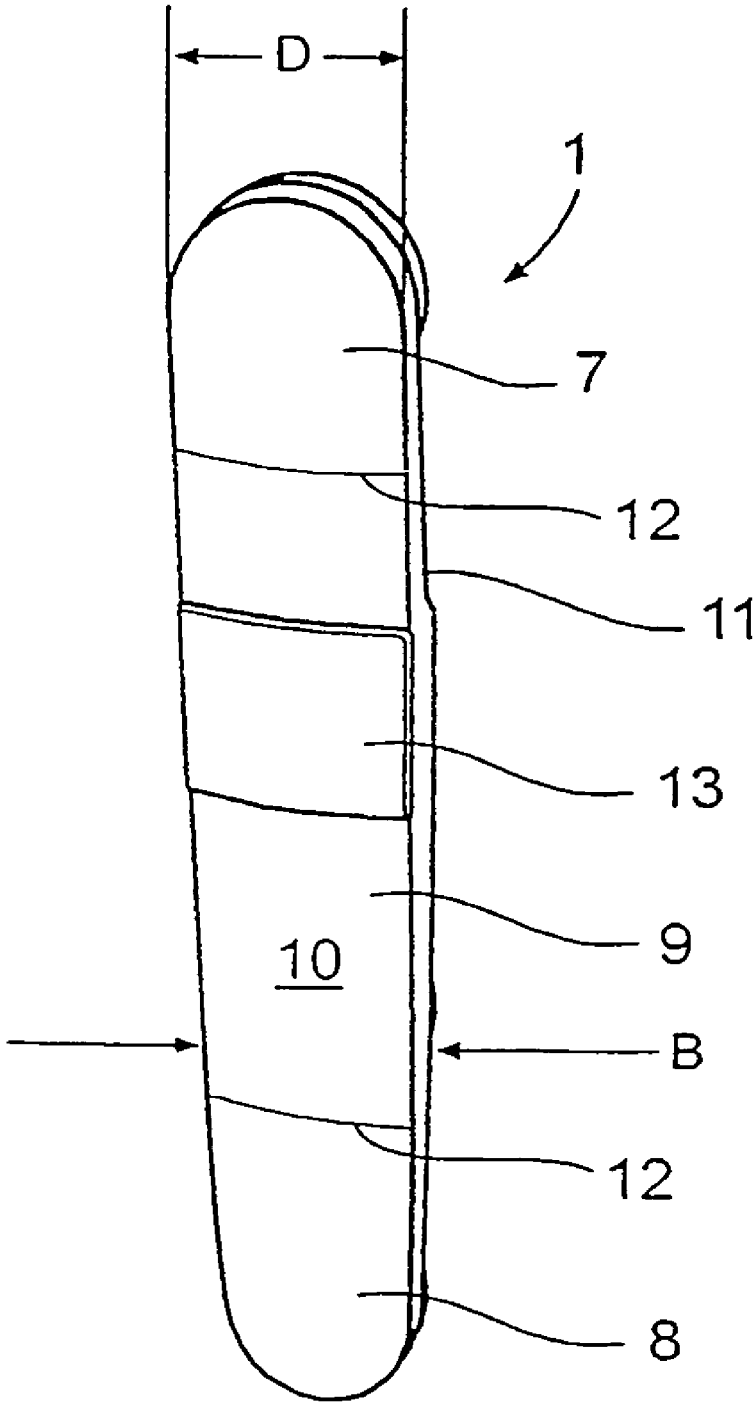
FIG. 1 shows a front view of a hanger.
Figure 2:
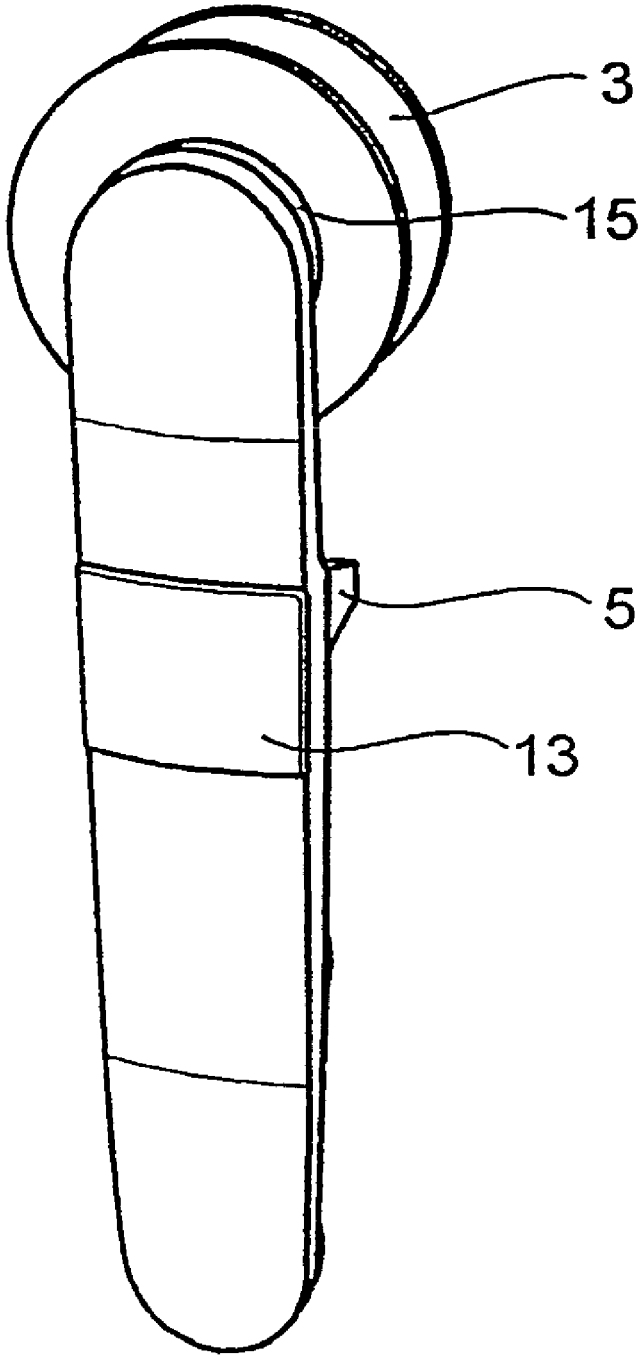
FIG. 2 shows a front view of a hanger on which a support roller is mounted.
Figure 3:
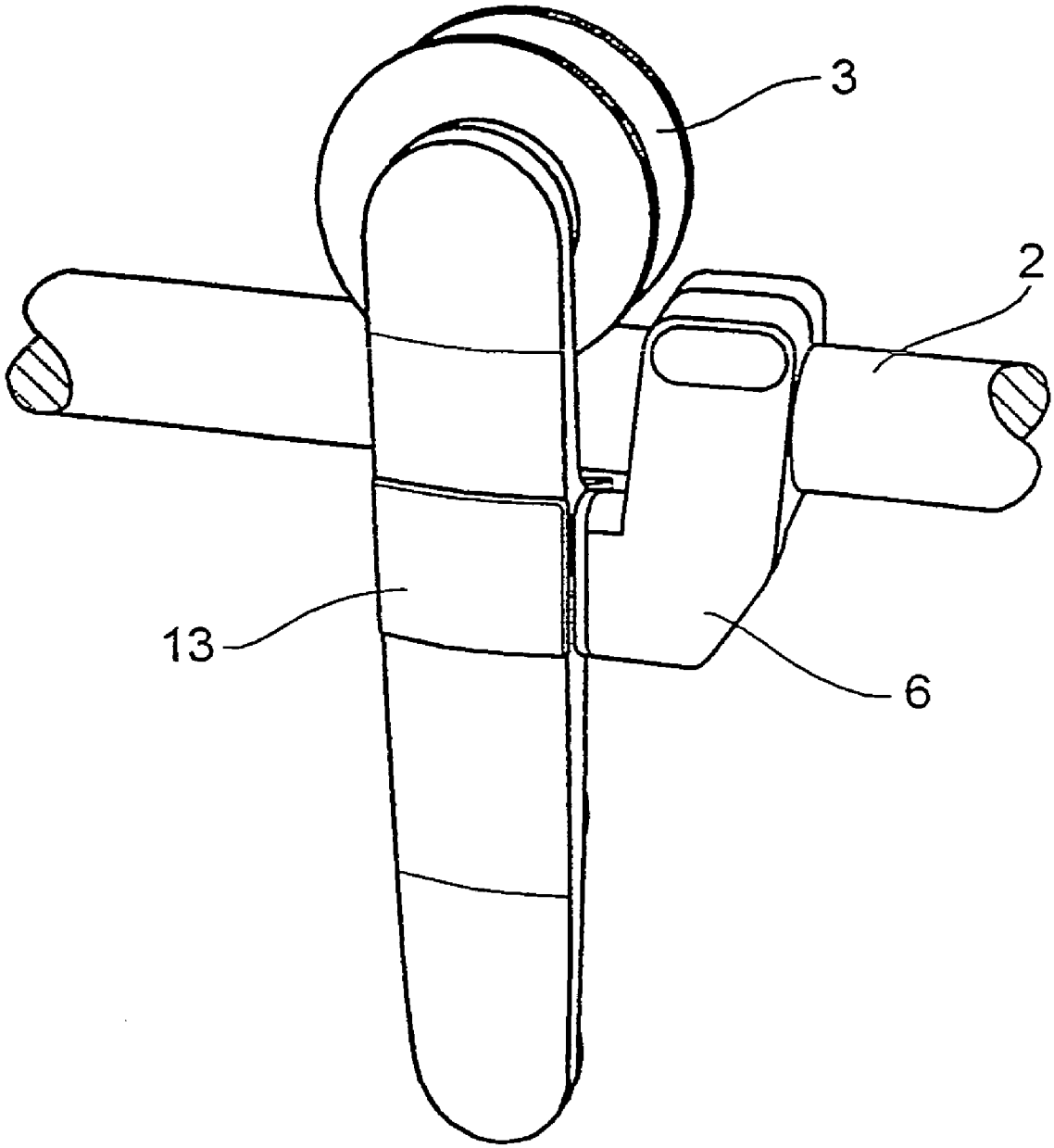
FIG. 3 shows a view of a hanger with stopper, the hanger being guided by a support roller on a guide rail so that the hanger can move back and forth.
Figure 4:
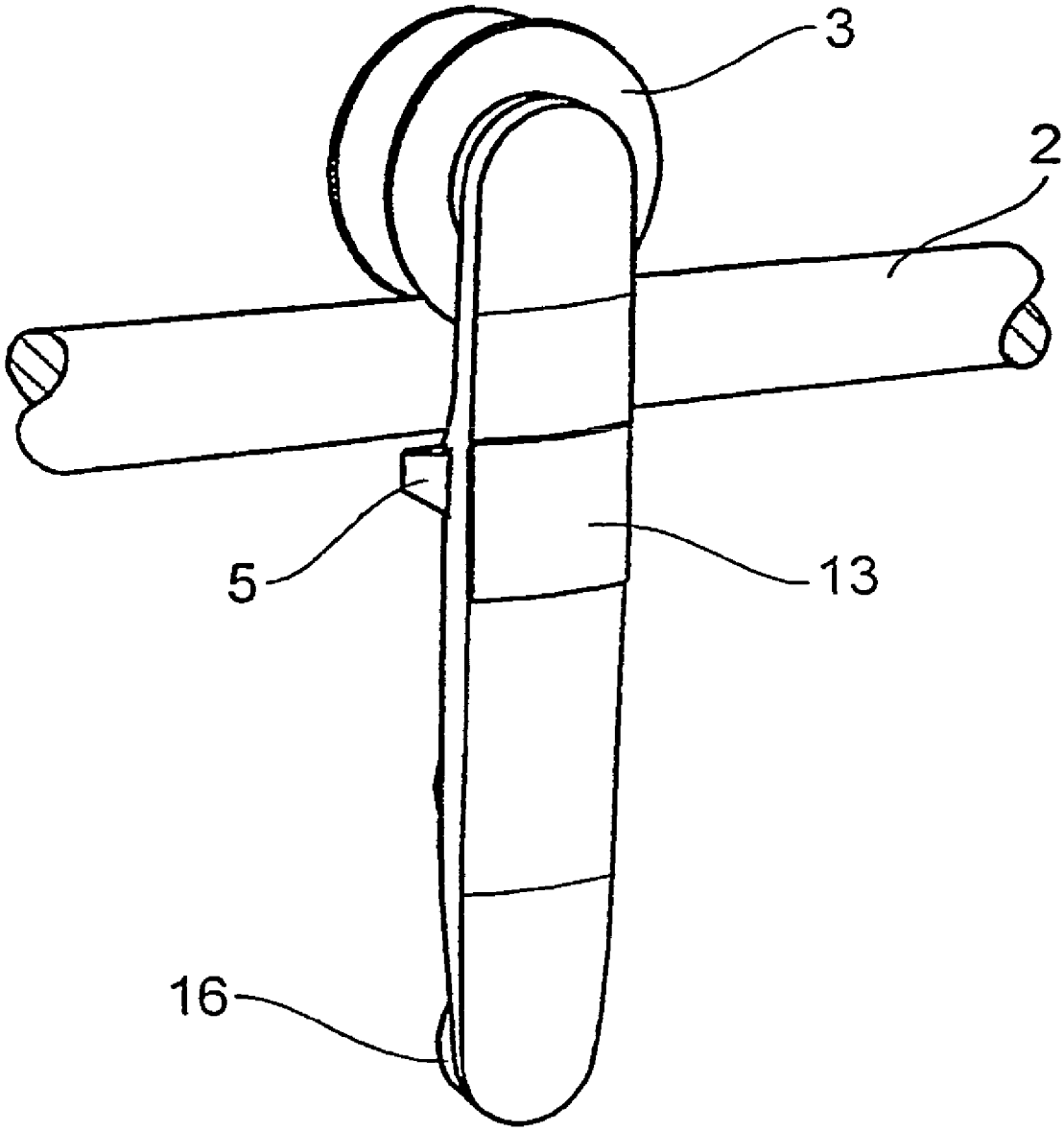
FIG. 4 shows a view of a hanger being guided by a support roller on a guide rail so that the hanger can move back and forth.
Figure 5:
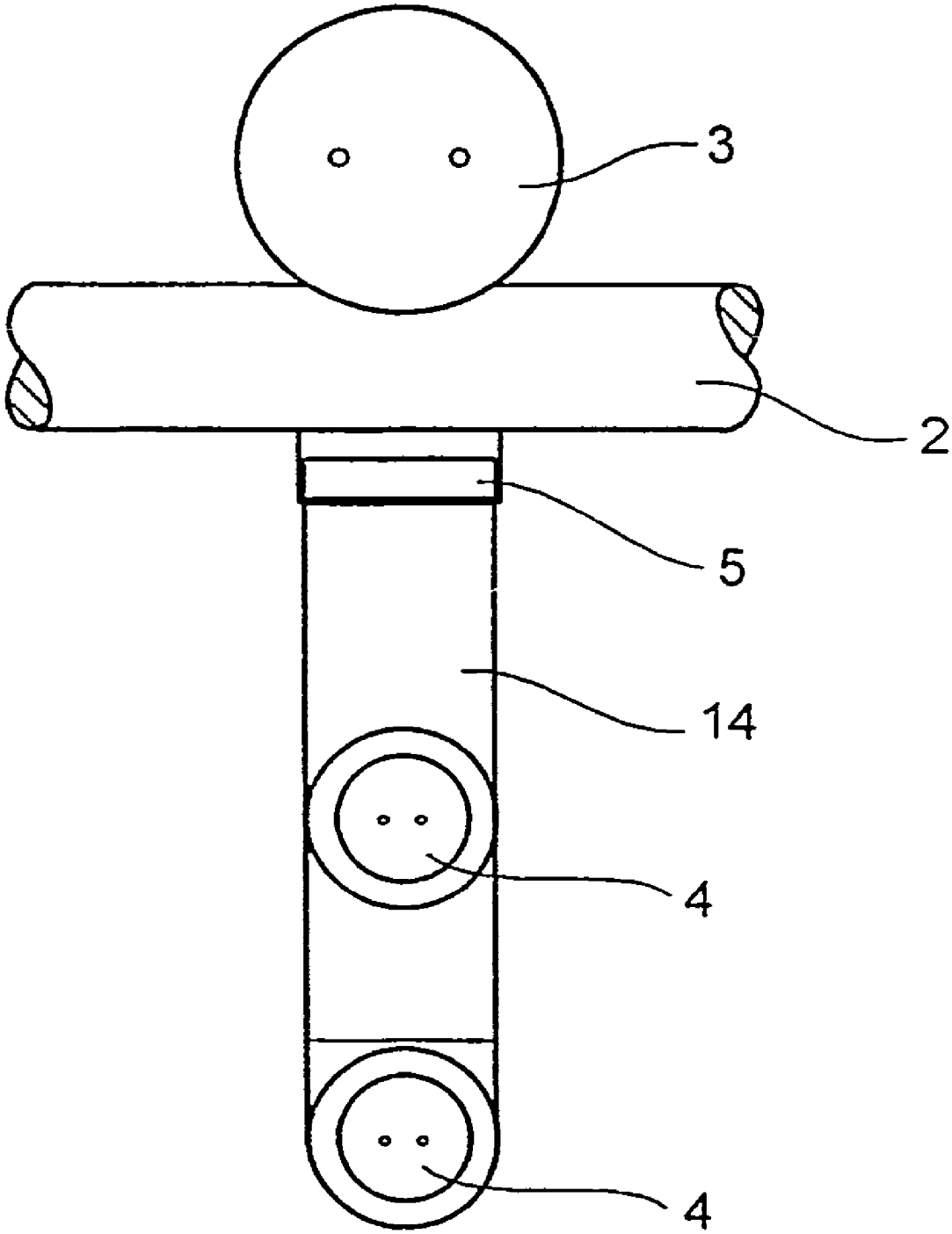
FIG. 5 shows a rear view of the hanger according to FIG. 4.
Figure 6:
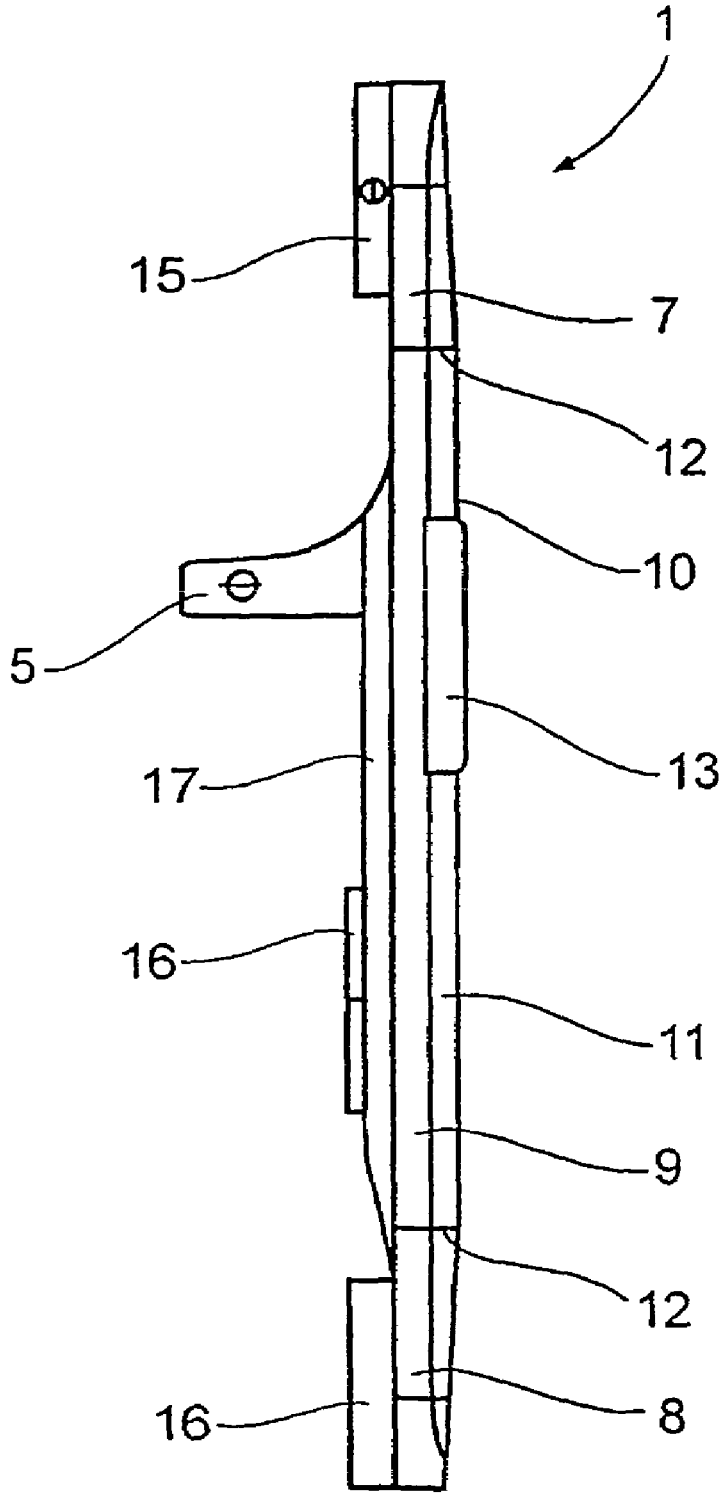
FIG. 6 shows a side view of the hanger according to FIG. 2 without a support roller.

In FIGS. 1–6, reference number 1 designates a hanger, by means of which the element (not shown) can be mounted on a rail 2 with freedom to move back and forth. The hanger 1 is guided by a support roller 3 on the top surface of the rail 2, which is attached to a substructure (not shown). Point holders 4, by means of which the element is attached, can also be provided on the hanger 1. There is the option of installing a keeper 5 and/or a stopper 6 between the roller 3 and the point holders 4. The element can be a door which closes off a room or the door of a cabinet or storage unit. Variable-position elements which perform separating functions both in rooms and in cabinets or storage units are also conceivable.

The hanger 1 has a basically flat, elongated shape with a middle section 9 extending between two opposite end areas 7 and 8 and forms a single unit with them. The two end areas 7 and 8 are designed as projecting semicircles. The middle section 9 has a uniform width B, which continues into the two end areas 7, 8 and is equal to the diameter D of the semicircular end areas 7, 8.

The surface 10 of the hanger 1 facing the observer is not interrupted by any functional elements and is slightly convex; that is, the surface 10 rises inward to form a slight elevation above the surrounding edges 11. The transitions between the end areas 7, 8 and the middle section 9 are emphasized visually by transverse grooves 12. In the middle section 9, a cover 13 is integrated so that it fits flush with the surface 10. The cover 13 conceals the area where the keeper 5 is attached to the rear surface.

On the rear surface 14, i.e., the surface facing away from the observer, the roller 3 is attached to the upper end area 7 of the hanger 1; this roller guides the hanger 1 along the rail 2 so that the hanger is free to move back and forth. The roller 3 is supported by a bearing body 15 connected to the hanger 1. This bearing body is circular and has the same diameter D as the semicircular end area 7. The bearing body 15 is thus concealed from the outside observer by the end area 7.

At the bottom end area 8, there are two point holders 4 on the rear surface for the attachment of the element which is to be guided movably on the rail 2. The point holders 4 are attached to shoulders 16, which are themselves connected to the hanger 1 and include appropriate fastening means. The shoulders are circular in shape. The diameter D of the shoulders 16 corresponds to the maximum width B of the hanger 1 or to the maximum diameter D of the semicircular end area 8, which means that the shoulders 16 are concealed from the observer by the end area 8.

The keeper 5 located on the rear surface of the middle section 9 prevents the hanger 1 from jumping unintentionally off the rail 2. After the hanger has been set on the rail 2, the keeper 5 is mounted and attached from the front side. A stop 6 can also be mounted on the side of the hanger 1 to ensure that the element comes to rest gently and without noise against an appropriate limiter. Fastening means/openings are required on the rear for both options. So that a visually uniform surface can be created here, too, this area is concealed by a cover 17. At the same time, dirt is prevented from intruding into the area and causing malfunctions.

The above description of the exemplary embodiments according to the present invention serves only to illustrate and not to limit the invention. Within the scope of the invention, various changes and modifications are possible without exceeding the scope of the invention or its equivalents.

What is claimed is:

1. A hanger for guiding an element suspended from a rail, the hanger comprising:

a pair of rounded end areas each having a semicircular profile with a diameter;

a middle section extending between the end areas to define a substantially flat elongated shape having a convex front surface and a rear surface;

at least one shoulder provided on the rear surface, the at least one shoulder receiving a point holder attachable to a suspended element; and a cover fitted substantially flushly into the front surface.

2. A hanger for guiding an element suspended from a rail, the hanger comprising:

a pair of rounded end areas each having a semicircular profile with a diameter;

a middle section extending between the end areas to define a substantially flat elongated shape having a convex front surface and a rear surface; and at least one shoulder provided on the rear surface, the at least one shoulder receiving a point holder attachable to a suspended element, wherein the at least one shoulder is no wider than the diameter of the end areas.

3. A hanger for guiding an element suspended from a rail, the hanger comprising:

a pair of rounded end areas each having a semicircular profile with a diameter;

middle section extending between the end areas to define a substantially flat elongated shape having a convex front surface and a rear surface, the rear surface being formed with fastening areas;

at least one shoulder provided on the rear surface, the at least shoulder receiving a point holder attachable to a suspended element; and a cover concealing the fastening areas.

4. The hanger of claim 3, further comprising a keeper fastened to one of the fastening areas.

5. The hanger of claim 3, further comprising a stopper fastened to one of the fastening areas.

6. A hanger for guiding an element suspended from a rail, the hanger comprising:

a pair of rounded end areas;

a middle section extending between the end areas to define a substantially flat elongated shape having a convex front surface and a rear surface; and a cover fitted substantially flushly into the front surface.

7. The hanger of claim 6, wherein the middle section has a width which is the same as the diameter of the end areas.

8. The hanger of claim 6, wherein the middle section has lateral edges, the front surface rising from the lateral edges.

9. The hanger of claim 6, further comprising a bearing body mounted on the rear surface, the bearing body carrying a roller which can travel along the rail.

10. The hanger of claim 9, wherein the bearing body is no wider than the diameter of the end areas.

11. A hanger for guiding an element suspended from a rail, the hanger comprising:

a pair of rounded end areas;

a middle section extending between the end areas to define a substantially flat elongated shape having a convex front surface and a rear surface, wherein the rear surface is formed with fastening areas;

a cover concealing the fastening areas;

a keeper fastened to one of the fastening areas; and a stopper fastened to one of the fastening areas.

* * * * *